United States Patent [19]

Porel

[11] 4,004,863

[45] Jan. 25, 1977

[54] HYDRAULIC PUMP WITH REMOTE CONTROL EQUIPMENT

[75] Inventor: Louis-Claude Porel, Ramberville, France

[73] Assignee: Etablissements Rene Leduc & Fils, Ramberville, France

[22] Filed: Jan. 27, 1975

[21] Appl. No.: 544,382

[30] Foreign Application Priority Data

Jan. 30, 1974 France ..... 74.03009

[52] U.S. Cl. ..... 417/271; 417/319

[51] Int. Cl.[2] ..... F04B 9/00

[58] Field of Search ..... 417/223, 319, 269, 271; 192/67; 91/473; 74/333;342;346

[56] References Cited

UNITED STATES PATENTS

| | | | |
|---|---|---|---|
| 1,242,474 | 10/1917 | Riley | 74/346 |
| 2,010,556 | 8/1935 | Nenninger | 74/333 |
| 2,481,441 | 9/1949 | Parsons | 417/269 |

FOREIGN PATENTS OR APPLICATIONS

| | | | |
|---|---|---|---|
| 713,278 | 10/1931 | France | 417/223 |

*Primary Examiner*—William L. Freeh
*Assistant Examiner*—G. P. La Pointe
*Attorney, Agent, or Firm*—Darby & Darby

[57] ABSTRACT

The pump comprises a casing containing the pump shaft. The casing includes a lateral housing containing an axially slidable shaft. The slidable shaft carries a first pinion, while the pump shaft carries a second pinion which is firmly connected thereto. The slidable shaft is held in a first extreme position by a spring and can be axially displaced, against the force of the spring, to a second extreme position by pneumatic control means. The control means include a piston portion which forms part of the slidable shaft. One of the said positions is a working or pumping position in which there is a driving contact, e.g. between the sliding shaft and a driving shaft, between the first pinion and a driving pinion, or between a first and second pinion.

10 Claims, 4 Drawing Figures

HYDRAULIC PUMP WITH REMOTE CONTROL EQUIPMENT

SUMMARY OF THE INVENTION

The invention relates to a hydraulic pump comprising means permitting the remote control of the engagement of the pump with the power supply intended for the driving thereof, and is more particularly concerned with pumps with which tipper lorries (dump trucks) are equipped, of which the tipper (dump) bodies are controlled by hydraulic jacks.

In the lorries of this type, the hydraulic pump feeding the jacks for tipping the tipper body only have to be brought into use when it is desired to cause the body to tip, the drive being effected from the gearbox of the lorry.

In the known arrangements, this engagement is produced by means of a pneumatically actuated dog-clutch system, which has the disadvantage of being of considerable size, this making difficult the adaptation of a standard assembly on several types of tipper bodies.

The present invention has for its object to overcome this disadvantage and is concerned with a hydraulic pump comprising pneumatic engaging and disengaging means combined with the pump.

BRIEF DESCRIPTION OF THE DRAWINGS

The invention will now be described, by way of example, with reference to the accompanying drawings in which.

DETAILED DESCRIPTION OF THE PREFERRED EMBODIMENT

Figure 1:
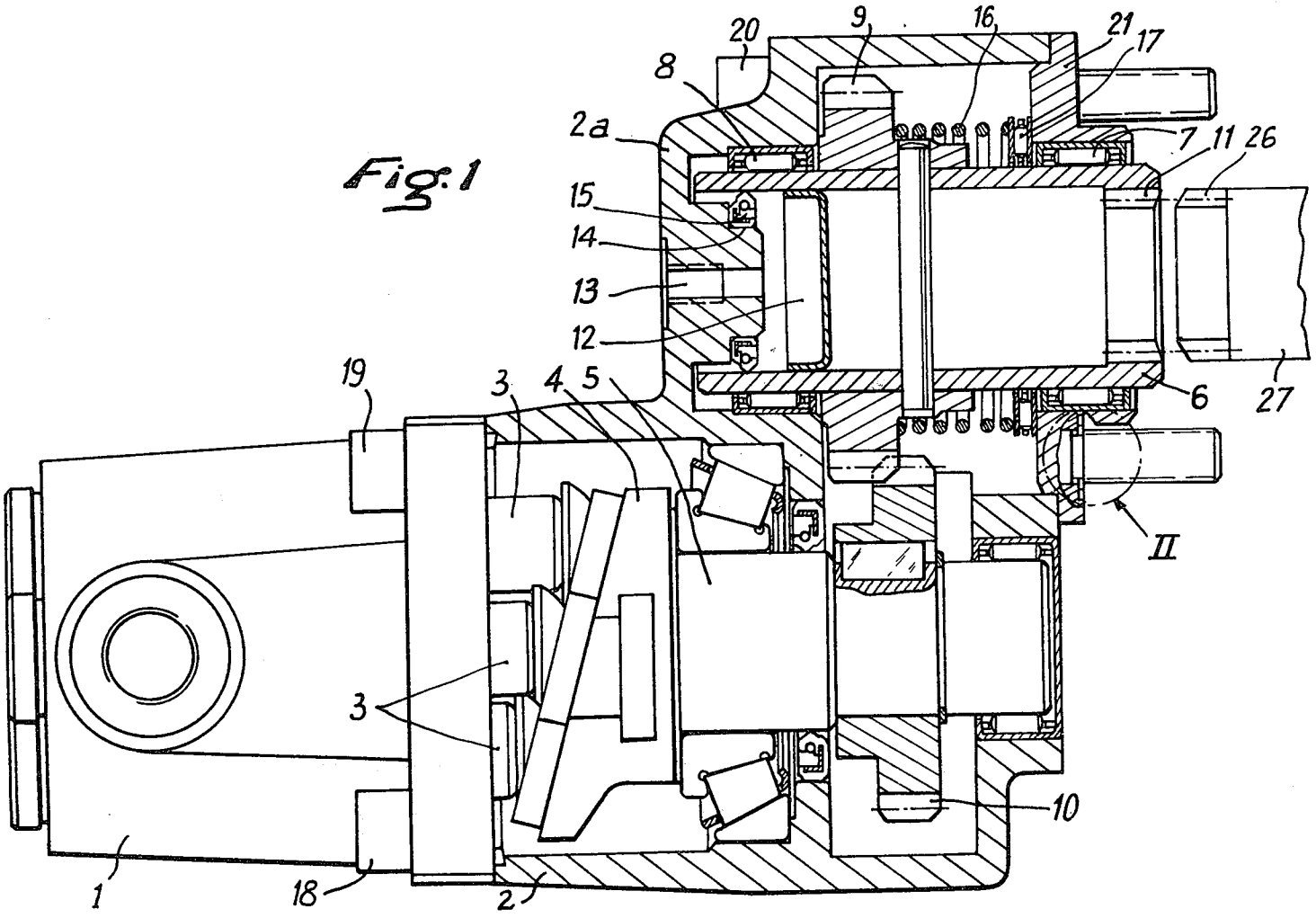
FIG. 1 is a partial view in section of a hydraulic pump equipped with a means according to the invention.

Referring to FIG. 1, it is seen that the hydraulic pump comprises, as is customary, a casing in two parts 1 and 2. The part 1 houses the intake and delivery pistons 3, and the part 2 houses a swash plate 4 and its driving shaft 5.

According to the present invention, the part 2 of the casing includes a lateral housing 2*a* serving as support for a movable shaft 6 intended to ensure the driving of the pump. The housing 2*a* is closed by a cover 21.

Figure 2:
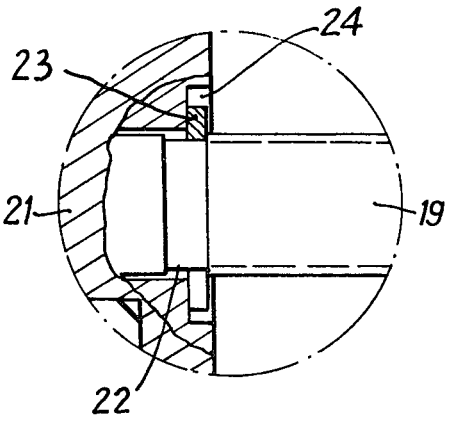
FIG. 2 is a view to a larger scale, showing a detail of FIG. 1.

In the example illustrated in FIGS. 1 and 2, the shaft 6 is mounted in two roller bearings 7 and 8 and carries a pinion 9 which is keyed thereto and is adapted to come into mesh with a pinion 10, which is keyed on the shaft 5 of the pump.

The shaft 6 is hollow and comprises at its outer end, which projects from the housing 2*a*, internal splining 11 which is adapted to fit over complementary splining 26 on the output shaft 27 of the gearbox of the lorry, which shaft is called the power supply shaft.

Arranged inside the hollow shaft 6 is a fluid-tight partition 12, which faces an orifice 13 for the intake of air under pressure. The orifice 13 is surrounded by a boss 14, serving as a support for a rotatable joint 15 disposed inside the shaft 6.

The pinion 9 and hence the shaft 6 is supported by a spring 16 bearing at one end against the pinion 9 and at the other end against a rotatable stop 17.

When the air pressure enters by way of the orifice 13, it forces back the shaft 6 by means of the fluid-tight partition 12 and the internal splines 11 of the shaft 6 come into engagement with the splines 26 of the power supply shaft 27 of the lorry (not shown); simultaneously, the pinion 9 comes into mesh with the pinion 10 and the shaft 5 of the pump is driven by the power supply shaft 27 of the lorry.

Referring to FIG. 1, it is seen that the part 1 of the casing is screwed on to the part 2 by means of four screwbolts 18 and 19. The two screwbolts 18 serve merely for fixing the parts 1 and 2, but the two screwbolts 19 project outside the part 2 of the casing and serve for fixing the pump to the lorry, in co-operation with the screwbolts 20. The cover 21 of the boss 2*a* is fixed by the screwbolts 19 and 20.

When the pump is placed in position, the tightening of the screwbolts 18, 19 and 20 obviously ensures the locking one against the other of the parts 1 and 2, on the one hand, and the housing 2*a* and cover 21, on the other hand, but it is necessary for these parts to remain assembled one with the other even when the pump is not in position.

For this purpose, the screwbolts 19 and 20 comprise each, as shown in FIG. 2, a peripheral groove 22 in which is placed a ring 23, the ring 23 extending into a circular recess 24 which is cut in the cover 21, the depth of the recess 24 being at least equal to and preferably slightly greater than the thickness of the ring 23. In addition, there is no screw-thread in the parts of the casing 2 and housing 2*a* through which the screwbolts 19 and 20 pass.

The cover 21 and the screwbolts 19 and 20 are thus held in position by the rings 23. In order for the tightening of the screwbolts 19 and 20 to be able to be operated normally, it is sufficient for the groove 22 to be of such a size that, once the assembly is placed in position, that is to say, the four screwbolts 19 and 20 are fitted, the ring 23 does not assume a bearing position on the wall carrying the pump.

Figure 3:
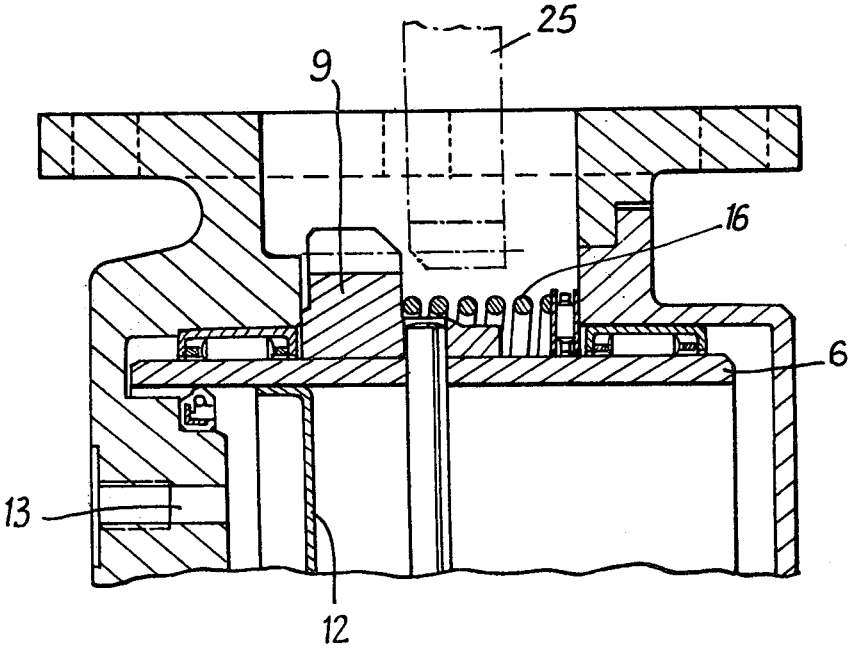
FIG. 3 is a partial view in section, showing a modification of FIG. 1.

FIG. 3 represents a second embodiment in which the same elements bear the same references.

This modified form differs from the previous form in that the pinion 9 meshes simultaneously with the pinion 10 and with a driving pinion 25 which drives it.

Figure 4:
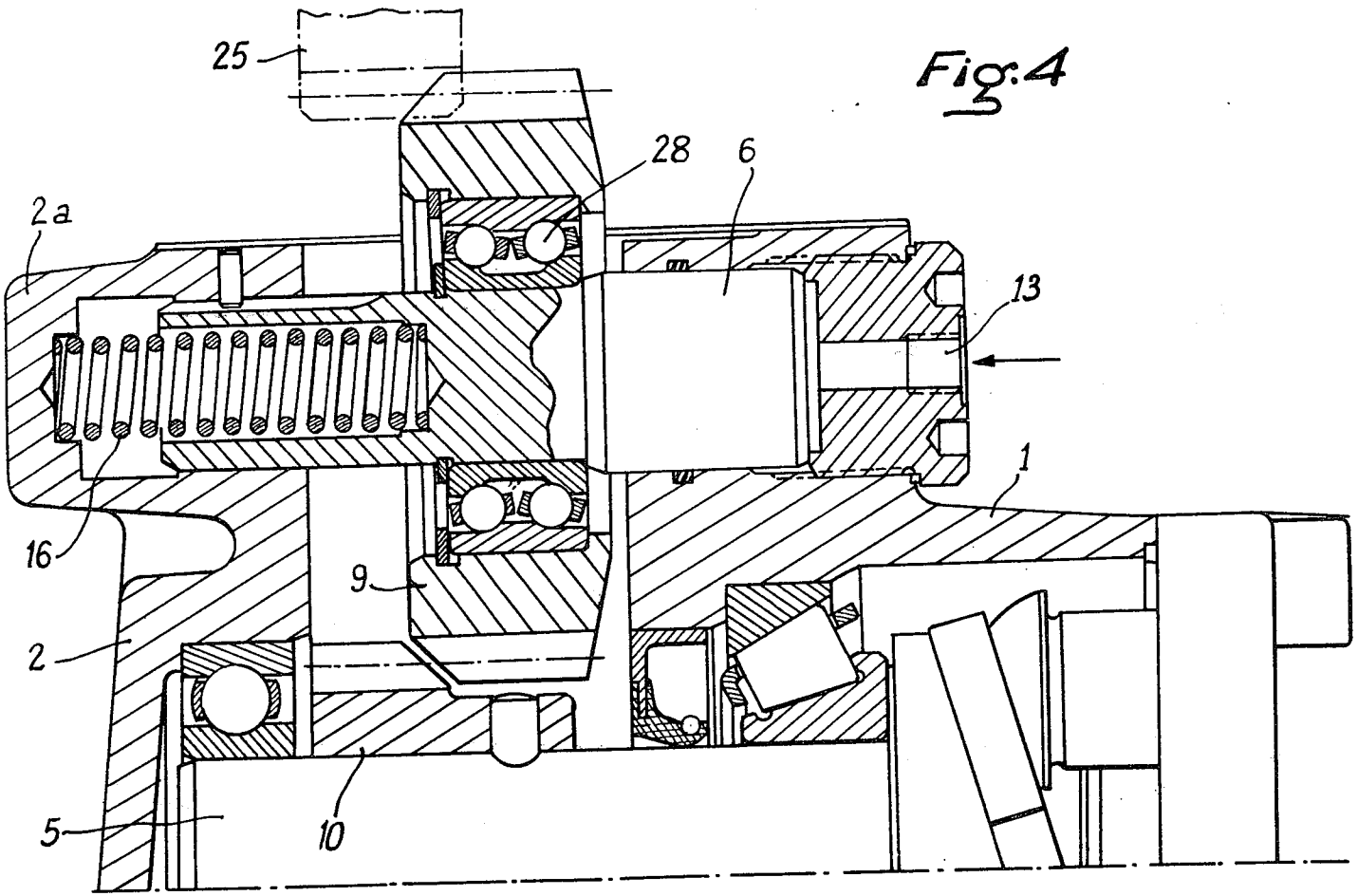
FIG. 4 is a partial view in section, showing another modified form.

FIG. 4 represents a third embodiment, in which the same elements bear the same references.

In the embodiment described with reference to FIG. 1, the shaft 6 is driven for rotation by the splines 26 and in the embodiment shown in FIG. 3 by the pinion 25. Both these embodiments require rotating joints and needle bearings for supporting the shaft 6.

In the embodiment shown in FIG. 4, the pinion 9 is mounted for rotation by means of a double-row ball bearing 28 on the shaft 6, which is solid.

I claim:

1. A hydraulic pump adapted to be driven by a rotating member of another device, said pump comprising a casing, a pump driving shaft mounted in said casing, pump means supported in said casing driven by said driving shaft, an auxiliary housing attached to said casing, a shaft slidably mounted in said auxiliary housing, driving gear means mounted on said slidable shaft, mating, interengaging mechanical means on said slidable shaft and said rotating member of said other device for directly driving the slidable shaft when said means are interengaged, gear means mounted on said pump shaft adapted to be engaged and driven by said driving gear means on said slidable shaft, means for biasing said slidable shaft to a first position wherein said driving gear means of the slidable shaft is out of driving engagement with the driven gear means of the pump driving shaft and the interengaging means of the slidable shaft is out of engagement with the mating, interengaging means of said rotating member, means for supplying fluid under pressure to said slidable shaft to move it against the force of the biasing means to a second position wherein the interengaging means of the slidable shaft is engaged by the mating, interengaging means of said rotating member of the other device so that the driving gear means is rotated and the driving and driven gears are engaged to rotate the pump shaft.

2. A pump as in claim 1 wherein the driving gear means is fixed to said slidable shaft and said slidable shaft is rotated when in said second position.

3. A pump as in claim 2 wherein said interengaging means of said slidable shaft comprises spline means on said slidable shaft adapted to engage corresponding spline means of said rotating member of said other device when said slidable shaft is in said second position.

4. A pump as in claim 1 wherein said interengaging means of said slidable shaft comprises said driving gear means which is adapted to engage the rotating member of said other device when the slidable shaft is in said second position.

5. A pump as in claim 4 wherein said driving gear means is fixed to said slidable shaft so that both said slidable shaft and said pump shaft are rotated when the slidable shaft is in said second position.

6. A pump as in claim 4 wherein said driving gear is rotatably mounted on said slidable shaft.

7. A pump as in claim 1 wherein said slidable shaft has a pressure surface to which the fluid pressure is applied.

8. A pump as in claim 7 wherein the slidable shaft is at least partially hollow and said pressure surface is located on the interior of said shaft.

9. A pump according to claim 1 wherein the casing and the housing are composed of parts held locked in relation to one another by screw bolts for fixing the pump to its support.

10. A pump according to claim 9 wherein each of the screw bolts is provided with a peripheral groove accommodating a ring given at the time of tightening a position in an annular recess in the casing or housing, the depth of the recess being greater than the thickness of the ring.

* * * * *